United States Patent [10]

LeBlanc et al.

[11] 4,013,813

[45] Mar. 22, 1977

[54] AMINOALKYLPHOSPHONIC ACID ESTER-BASED TEXTILE FIRE RETARDANTS

[75] Inventors: Robert Bruce LeBlanc, Wickford; James Henry Badger, Narragansett, both of R.I.

[73] Assignee: LeBlanc Research Corporation, East Greenwich, R.I.

[22] Filed: Feb. 27, 1975

[21] Appl. No.: 553,872

[52] U.S. Cl. ..... 428/272; 252/8.1; 260/944; 427/341; 427/342; 427/390 D; 427/392; 428/276; 428/277; 428/278; 428/921

[51] Int. Cl.[2] ..... C09K 3/28; C09D 5/18

[58] Field of Search ..... 427/341, 342, 392, 390 D; 260/944, DIG. 24; 106/15 PP; 252/8.1; 428/921, 276–278, 272

[56] References Cited

UNITED STATES PATENTS

| | | | |
|---|---|---|---|
| 2,772,188 | 11/1956 | Reeves et al. | 427/341 |
| 3,551,422 | 12/1970 | Tesoro et al. | 252/8.1 X |
| 3,755,323 | 8/1973 | Weil et al. | 252/8.1 X |
| 3,813,456 | 5/1974 | Kerst | 260/944 X |
| 3,908,051 | 9/1975 | Yamamoto | 427/382 X |

OTHER PUBLICATIONS

Fields, "Synthesis of Esters...", J.A.C.S., vol. 74, pp. 1528–1531 (1952).

*Primary Examiner*—Harry J. Gwinnell
*Attorney, Agent, or Firm*—Burgess, Dinklage & Sprung

[57] ABSTRACT

New aminoalkylphosphonic acid esters of the formula $$(RO)_2\overset{\overset{O}{\|}}{P}C(R_1)(R_2)NHR_3$$

wherein

R is H or alkyl of up to 4 carbon atoms, $R_1$ is H or $CH_3$, $R_2$ is H, $CH_3$ or $-C(R_1)(NHR_3)P(O)OR_2$, and $R_3$ is H, $-C(R_1)(R_2)P(O)(OR)_2$ or $-CH_2CH_2NHC(R_1)(R_2)P(O)(OR)_2$, are prepared from $(RO)_2P(O)H$, $NH_3$ or ethylene diamine and formaldehyde, glyoxal, acetaldehyde or acetone. These new compounds can be reacted with methylol phosphorus compounds of the formula $$P(CH_2OH)_4Y \text{ or } P(CH_2OH)_3$$

where Y is an equivalent amount of the anion of at least one acid, and optionally additionally with urea. The reacting molar ratio of the hydroxymethyl phosphorus compound to the aminoalkylphosphonic acid ester is up to about 6:1 and preferably between about 0.5:1 and 3:1. Advantageously, the hydroxymethyl phosphorus compound is a tetrakis(hydroxymethyl)phosphonium salt, preferably neutralized with caustic soda, and the aminoalkylphosphonic acid ester is O,O-dimethyl aminomethylphosphonate (DAMP). The condensation product, dissolved in water, is padded onto a fabric, preferably a polyester/cotton blend, which is thereafter dried and cured thermally and/or chemically. The fabrics are fire retardant even after multiple launderings.

4 Claims, 1 Drawing Figure

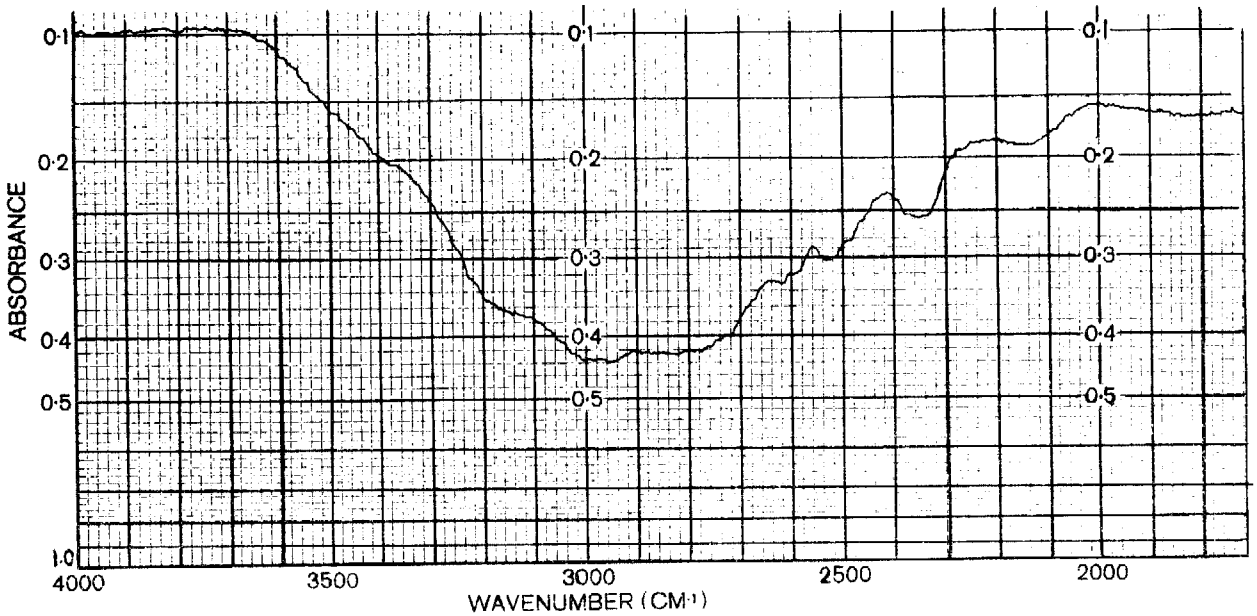
ABSORBANCE
0·1
0·2
0·3
0·4
0·5
1·0
4000
3500
3000
2500
2000
WAVENUMBER (CM⁻¹)
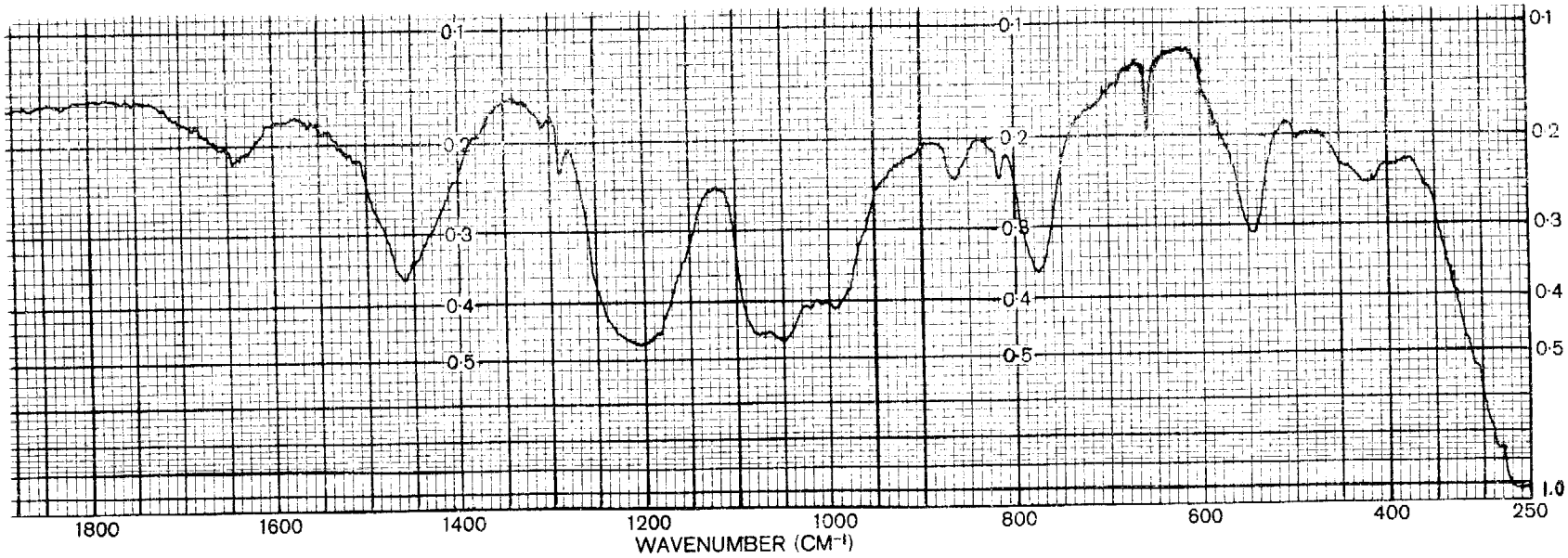
0·1
0·2
0·3
0·4
0·5
1·0
1800
1600
1400
1200
1000
800
600
400
250
WAVENUMBER (CM⁻¹)

AMINOALKYLPHOSPHONIC ACID ESTER-BASED TEXTILE FIRE RETARDANTS

BACKGROUND OF THE INVENTION

The present invention relates to novel water soluble products derived from methylol phosphorous compounds and aminoalkyl phosphonic acid esters and their derivatives, to the processes of using these water soluble materials to produce flame retardant textile materials, and to the flame retardant textile materials so produced.

The practice of treating textile materials for flame retardance has assumed increasing importance with the adoption of federal, state and municipal legislation designed to protect the public from unreasonable hazards of flammable textile products. The technological difficulties in providing treated textile materials and the required standards are quite well known.

It has been shown by numerous workers in the field that compounds containing phosphorus are effective flame retardants for textiles. The major problem is how to bind such phosphorus compounds to the textiles substrates, so that the bound phosphorus compound will remain attached to the fabric after multiple launderings, without destroying the esthetic appeal of the treated fabric.

The fabrics which are of major commercial importance for flame retardant treatment are those containing cellulosic materials such as cotton or rayon and/or those containing polyester. A commercially satisfactory treatment for polyester/cotton blended fabrics containing significant amounts of polyester has not yet been developed.

Many classes of phosphorus compounds have been disclosed in the prior art for the purpose of affording flame retardant textiles. These include phosphoramides or phosphoramidates, phosphates, phosphonic and phosphoric acids, phosphonates and phosphonium compounds. The only chemical classes which have had any commercial success to date are the phosphonates and the phosphonium compounds.

The phosphonium compounds referred to above are tetrakis (hydroxymethyl)phosphonium salts, the best known of which is the chloride. Reeves and Guthrie in U.S. Pat. No. 2,809,941 used a solution of tetrakis(hydroxymethyl)phosphonium chloride, melamine-formaldehyde resin and urea to treat cotton fabrics by a pad-dry-cure method. This treatment and slight modifications of it have been used commercially to give cotton fabrics flame-retardance durable to multiple launderings. The treatment, however, causes high fabric strength losses and makes the fabrics too stiff to use except for certain areas such as industrial cotton work clothing and tent liners.

Reeves and Guthrie in their later-filed U.S. Pat. No. 2,772,188 disclosed an improved process for forming an insoluble polymer of tetrakis(hydroxymethyl)phosphonium chloride in cellulosic fabrics by what is known as a chemical cure. In water there was made a prepolymer of tetrakis(hydroxymethyl)phosphonium chloride and either methylolmelamine or urea or phloroglucinol. This solution was padded onto cotton fabric. The fabric was dried and then treated with ammonia (chemical cure) to produce an insoluble polymer in and on the fabric. The fabric was fire retardant.

Coates in U.S. Pat. No. 2,983,623 improved on this process by using a chemical cure which consisted of treating impregnated fabric first with gaseous ammonia and then with aqueous $NH_3$. Pre-condensates were made by refluxing tetrakis(hydroxymethyl)phosphonium chloride in water containing either urea, melamine, a urea and thiourea mixture, dicyandiamide or guanidine. Water solutions of the pre-condensate were padded onto cotton fabric. The fabric was dried and subsequently put first into a gaseous ammonia chamber and then into an aqueous solution of ammonia to form an insoluble polymer in and on the fabric. This fabric was flame-retardant. The particular process using a tetrakis(hyrdoxymethyl)phosphonium chloride-urea pre-condensate has become commercial and is known as the "Proban" process. It is adequate for cellulosic textiles, but is not satisfactory for polyester-cotton blend fabrics.

Coates and Chalkey in U.S. Pat. No. 3,236,676 further simplified the process by using tetrakis(hydroxymethyl)phosphonium salts (abbreviated THP salts) neutralized with a base such as NaOH to a pH between 3 and 9.5 instead of the tetrakis(hydroxymethyl)phosphonium chloride-urea precondensate. Fabric was padded with the neutralized THP salt, dried and given a heat cure sufficient to fix the THP salt on the fabric. Subsequently the fabric was treated with ammonia to form an insoluble polymer in and on the fabric.

Beninate et al. in U.S. Pat. No. 3,607,356 improved on this process by omitting the heat cure to fix the THP salt prior to the treatment with gaseous ammonia. They neutralized THP salt with a base such as NaOH to a pH of about 7.5 to 7.9 They called this neutralized product THPOH. In reality a solution of THP salt neutralized in this way consists mostly of tris(hydroxymethyl)phosphine (Reeves et al., Textile Chemist and Colorist 2, 283–285 (1970)). Cotton fabric was padded with and aqueous solution of this "THPOH" and dried to a moisture content of about the normal cotton moisture regain, or a little higher. This fabric was then subjected to an atmosphere of dry, gaseous ammonia to form an insoluble polymer in and on the fabric. They claimed this process would give flame-retardance not only to cellulosic fabrics and wool but also to polyester-cotton blends. This process has been commercialized and is adequate for cotton fabrics, but does not give adequate flame-retardance to a polyester-cotton blend containing more than 20% polyester.

LeBlanc and Gray (Textile Chemist and Colorist 3, 263–265 (1971)) did a study on the application of THPOH finish to polyester-cotton blends. They found that it is possible to give a minimum level of fire-retardance to blends which have no more than 12.5–25% polyester. Even at these levels of polyester, the treated fabrics were excessively stiffened by the treatment.

The phosphonate finishes which are currently in commercial usage are effective only on fabrics containing more than about 85% cotton. These finishes contain methylolated dimethyl phosphonopropionamide which is disclosed by the CibaGeigy Corporation in U.S. Pat. No. 3,374,292 and an oligomeric vinyl phosphonate called Fyrol 76 and discussed by the Stauffer Chemical Company in the *Proceedings of the* 1974 *Symposium on Textile Flammability* published by LeBlanc Research Corporation. The methylol phosphonopropionamide is co-applied to fabric with a melamine-based resin binder and given a thermal cure in order durably to fix the phosphonate to the substrate. The oligomeric vinyl compound is applied to fabric in conjunction with N-methylolacrylamide and a free radical initiator and the treated fabric is then given a thermal cure in order to co-polymerize the applied reactants in situ. A detailed description and the application of these two types of compounds to fabric may be found in the *Proceedings of the* 1974 *Symposium on Textile Flammability* published by the LeBlanc Research Corporation.

Ciba-Geigy Corporation has disclosed a developmental product, Pyrovatex 3762, for making polyester-cotton blends flame retardant (John Leddy and Rene Eckert, "Durable Flame Retardant Finishing of Cotton and Polyester-Cotton Blends," *Proceedings of the* 1973 *Symposium on Textile Flammability*, LeBlanc Research Corporation, East Greenwich, R.I.). From German Specification DOS No. 2,136,407 it appears the product, a "phosphonium oligomer" is a water-soluble self-condensation product of tetrakis(hydroxymethyl)phosphonium chloride. It can be applied to polyester-cotton blends by a pad-dry-cure-afterwash process. The padding solution contains the self-condensation product Pyrovatix 3762, a dimethylolmelamine, urea, a softener and a wetting agent. The Pyrovatex 3762 has a highly objectionable phosphine-type odor during fabric processing and the processed fabrics are very stiff.

In British Pat. No. 761,985, ammonia is condensed with a THP salt but the product is a water-insoluble polymeric solid and is employed to treat cellulosic material as an emulsion in water. Products based on this patent have not been commercialized.

In *Chemical Abstracts*, Vol. 79 (1973) 20256x there is abstracted German DOS No. 2,242,681 which self-condenses tetrakis(hydroxymethyl)phosphonium chloride to remove water and leave a polymer which, with urea, forms a dispersible material for addition to viscose spinning dopes. In *Chemical Abstracts*, Vol. 79 (1973) 20258z there is abstracted German DOS No. 2,242,682 wherein THPC is condensed with an amine such as dodecylamine in xylene to give a condensate. In *Chemical Abstracts*, Vol. 79 (1973) 93383w there is abstracted German DOS No. 2,255,113 wherein THPC is simultaneously reacted with ammonia and urea.

U.S. Pat. No. 3,772,068 discloses compounds containing phosphonium and phosphoramido-methyl groups for the treatment of polyester-cellulosic fabrics. This patent also discloses the co-application of phosphonium salts and dimethyl propionamide derivatives and resin binders for the treatment of polyester cellulosic blends. Similar products are also disclosed in U.S. Pat. No. 3,699,192. None of these treatments, however, is believed to be commercial.

Thus, while 50/50 or 65/35 polyester/cotton blend fabrics comprise about one-third of the total textile fabrics currently produced in the United States, at the present time there is no commercially available finish for flame retarding such polyester/cotton blends. One of the problems is that the polyester polymer fiber has no reactive groups on it such as the hydroxyl groups on the cellulose polymer. When the polyester content of a fabric approaches 50%, the number of available hydroxyl groups on the fabric is decreased to such an extent that it becomes difficult to attach flame retardant compounds to the fabric. While Pyrovatex 3762 has more reactive methylol groups per molecule than do THP salts, so that it can by polymerized with a resin such as dimethylolmelamine with a higher efficiency than THP salts, its disadvantages have been outlined hereinabove.

GENERAL DESCRIPTION OF THE INVENTION

It is accordingly an object of the present invention to provide compositions useful for flame retarding textile materials, especially polyester/cotton textile fabrics. It is a further object to provide compositions which are characterized by their low cost and toxicity.

It is a further object to provide processes by which said compositions are used to flame retard textile materials.

It is a further object to provide flame retardant textile materials.

These and other objects are realized in accordance with the present invention pursuant to which there are provided aminoalkylphosphonic acid derivatives of the formula $$(RO)_2\overset{\overset{\displaystyle O}{\|}}{P}C(R_1)(R_2)NHR_3$$

wherein

R is H or alkyl of up to 4 carbon atoms, $R_1$ is H or $CH_3$, $R_2$ is H, $CH_3$ or $-C(R_1)(NHR_3)P(O)OR_2$, and $R_3$ is H, $-C(R_1)(R_2)P(O)(OR)_2$ or $-CH_2CH_2NHC(R_1)(R_2)P(O)(OR)_2$.

These compounds can be reacted with hydroxymethyl phosphorus compounds to produce condensates which are especially suited for application to textiles to render them durably fire retardant.

Preferred aminoalkylphosphonic acid esters are those of the above-recited formula wherein R is methyl or ethyl, $R_1$ and $R_2$ are hydrogen or one of them is methyl, and $R_3$ is $-CH_2CH_2NHC(R_1)(R_2)P(O)(OR)_2$ or even more preferably hydrogen.

Such aminoalkyl-phosphonic acid esters can be used to make oligomeric condensation products with hydroxymethyl phosphorus compounds of the formula $$P(CH_2OH)_4Y \text{ or } P(CH_2OH)_3$$

wherein Y is an equivalent amount of the anion of at least one acid, the hydroxymethyl phosphorus compound being present in up to about 6 times the molar amount of nitrogen in the aminoalkyl phosphonate. Y may be the anion of any acid such as the chloride, bromide, sulfate, bisulfate, phosphate, hydrogen phosphate, dihydrogen phosphate, phosphite, hydrogen phosphite, nitrite, nitrate, methylsulfate, toluenesulfonate, trichloroacetate, formate, acetate, propionate, oxalate, propane-1,2,3-tricarboxylate, citrate, succinate, malonate, and the like. The inorganic acids and organic acids containing up to four carbon atoms, especially alkanecarboxylic acids, are preferred. Of these, the oxalate, acetate, chloride, phosphate and various mixtures thereof, are especially preferred.

Instead of using a THP salt alone, it can also be advantageous to use the condensation product of a THP salt and a urea. This condensation product can be made by heating an aqueous solution of a THP salt and the urea in a mole ratio of about 1.5–2.5:1, preferably about 2:1.

In accordance with another aspect of the invention, the THP or THP salt can be condensed with ureidoalkylphosphonates and/or hydroxymethyl melaminealkylphosphonates in place of or in admixture with aminoalkylphosphonates. Such condensates can be used in the same manner as the novel aminoalkylphosphonates. The ureidoalkylphosphonates can be formed by reacting appropriate mole ratios of trimethyl phosphite, formaldehyde and urea in accordance with the teachings of U.S. Pat. Nos. 3,763,281 and 3,734,970. The ureidoalkyl phosphonates of interest in the practice of the present invention are:

$NH_2CONHC(R_1)(R_2)P(O)(OR)_2$ and $(RO)_2P(O)C(R_1)(R_2)NHCONHC(R_1)(R_2)P(O)(OR)_2$, especially $$NH_2CONHCH_2\overset{O}{\overset{\|}{P}}(OCH_3)_2$$ dimethyl ureidomethylphosphonate and $$(CH_3O)_2\overset{O}{\overset{\|}{P}}CH_2NHCONHCH_2\overset{O}{\overset{\|}{P}}(OCH_3)_2$$ tetramethyl ureido-bis-(methylphosphonate).

Melaminealkylphosphonates are disclosed in U.S. Pat. Nos. 3,755,323 and 3,551,422 and the former patent also refers to co-application with THPC and THP. However, the following should be considered:

1. THP and THPC are highly toxic and therefore their use as such should be avoided where possible.

2. It is believed that melamine alkyl phosphonates, when applied to blends, as their hydroxymethyl or methoxymethyl derivatives, do not afford both a satisfactory degree of flame retardance and satisfactory esthetics.

Reaction products of THPY and oxymethyl melamine alkylphosphonates in accordance with the present invention and of the formulas:

$(RO)_2P(O)C(R_1)(R_2)$-melamine-$CH_2$—O—$CH_3$ and especially $(RO)_2P(O)C(R_1)(R_2)$-melamine-$CH_2OH$ obviate these objections in that they are much less toxic and, when applied to fabrics, they form polymers containing high levels of phosphorus which are tenaciously held and which also give a commercially acceptable handle.

Returning to the aminoalkylphosphonates, illustrative members are those made by reaction of ammonia or ethylene diamine or salts thereof, carbonyl or polycarbonyl compounds and dialkyl hydrogen phosphite esters in accordance with the following equation:

$$R_3NH_2 + R_1R_2CO + H-\overset{O}{\overset{\|}{P}}(OR)_2 \longrightarrow R_3NHCR_1R_2\overset{O}{\overset{\|}{P}}(OR)_2$$

The ammonia may be used as such or in the form of an ammonium salt. The preferred nitrogen-containing reactant is ammonia because of its low cost and the effectivenss of the derived aminoalkylphosphonate.

Illustrations of suitable carbonyl compounds are formaldehyde, acetaldehyde, acetone, glyoxal and derivatives of these carbonyl compounds which will yield the free carbonyl compound during an appropriately catalyzed reaction. Examples of such derivatives are acetals and ketals and polymers such as trioxane, tetroxane, paraformaldehyde, paraldehyde, oximes and hydrazones.

Illustrations of suitable phosphite esters are dimethylhydrogen phosphite and diethyl hydrogen phosphite. Trimethyl phosphite and certain other suitable trialkyl phosphite may also be used since they are converted to hydrogen phosphites upon reaction with water.

The preferred aminomethylphosphonate is dimethyl aminomethylphosphonate (DAMP) which is made according to the following equation:

$$NH_3 + CH_2O + H-\overset{O}{\overset{\|}{P}}(OCH_3)_2 \longrightarrow NH_2CH_2\overset{O}{\overset{\|}{P}}(OCH_3)_2 + H_2O$$

The preparation of dimethyl aminomethylphosphonate has never been reported although the preparation of similar compounds is known, e.g.

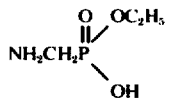

by ammonolysis of diethyl chloromethyl phosphonate according to Kabachnik and Medved, Izvest. Akad. Kauk SSSR, 1950, 635, and $$NH_2CH_2\overset{O}{\overset{\|}{P}}(OH)_2$$

in admixture with $$NH\left(CH_2\overset{O}{\overset{\|}{P}}(OH)_2\right)_2$$

and $$N\left(CH_2\overset{O}{\overset{\|}{P}}(OH)_2\right)_3$$

by reaction of ammonium chloride, formaldehyde and phosphorus acid, according to U.S. Pat. No. 3,288,846.

Indeed, the definitive work on the preparation of aminomethylphosphonate esters by Fields, J. Amer. Chem. Soc., 74, 1528–31 (1952) precludes the making of di-alkyl aminomethyl phosphonates by the reaction of ammonia, formaldehyde and dialkyl phosphites. Attempts to make dimethyl aminomethylphosphonate by methylation with diazomethane or dimethyl sulfate according to Medved & Kabachnik, Izvest. Akad. Nauk. S.S.S.R., 1951, 620, have proved unsuccessful.

Pursuant to the present invention, dimethyl aminomethylphosphonate may be made in aqueous solution by admixture of dimethyl phosphite and aqueous formaldehyde and subsequent reaction with aqueous ammonia, or by prior reaction of aqueous formaldehyde and aqueous ammonia and subsequent reaction with dimethyl phosphite, or by prior admixture of dimethyl phosphite and aqueous ammonia and subsequent reaction with aqueous formaldehyde.

Hydrolysis and ammonolysis of the phosphite ester may occur to some extent if the exothermic reactions are allowed to proceed without cooling. However, if the reactions are carried out under mild conditions so as to minimize hydrolysis, a product of pH 6 to 7 may be obtained.

Infrared spectroscopy (IR) and thin layer chromatography (TLC) establish the presence of the desired product. Thus, TLC shows the absence of dimethyl phosphite and hexamethylene tetramine (formed by spontaneous reaction of ammonia and formaldehyde) when the reaction is allowed to proceed to completion; consumption of these precursors is coupled with the formation of predominantly one new compound having the following IR absorptions:

| Frequency ($cm^{-1}$) | Assignment |
|---|---|
| Circa. 3460 (weak) | associated $NH_2$ |
| Ca. 3140 (medium) | " |
| Ca. 2760–3050 (strong band) | $CH_3$— and —$CH_2$— stretching |
| Ca. 2520–2605 (weak band) | amino-acid or P—OH |
| 2340 (weak) | unassigned |
| Ca. 1645–1680 (weak) | —$NH_2$ deformation |
| Ca. 1510 (weak) | $NH_3^+$ |
| Ca. 1460 (medium) | C—$CH_3$ and —$CH_2$— deformation |
| Ca. 1250 (medium) | free P=O |
| Ca. 1190–1230 (strong band) | P=O—HN— |
| Ca. 990, 1020, 1050, 1080 (strong overlapping peaks) | C—O stretching in C—O—P bonding |
| Ca. 956 (medium) | " |
| 860 (weak) | unassigned |
| 820 (weak) | " |
| 775–790 (medium overlapping peaks) | P—O stretching in C—O—P bonding |
| 710, 690, 650, 575, 495, 450, 420 (weak) | unassigned |
| 540 | unassigned; present in dimethyl phosphite |

The figure is the IR absorption spectrum of DAMP produced in Example 1A hereinbelow except that the reaction was alloweed to proceed to completion.

The nitrogen compound may be reacted with up to six times its molar amount of the hydroxymethyl phosphorus compound. At the higher molar ratio, TLC shows that some of the methylol phosphorus compound remains unreacted, while at a molar ratio of about 2:1 the methylol phosphorus compound is essentially fully reacted to form a new product. The preferred mole ratio range, when the intended substrate contains a significant quantity of polyester fiber, is about 0.5:1 to 3:1 and especially about 1.5:1 to 2:1. If the intended substrate is 100% cellulosic or mainly cellulosic in nature, then the preferred molar ration range is about 0.5:1 to 1:1; this range is preferred because dimethyl aminomethylphosphonate is less expensive to made than the hydoxymethyl phosphorus compound and, for the treatment of mainly cellulosic fabrics, a greater amount of the phosphonate can be tolerated without significant loss in laundering durability of the finished flame retardant fabric.

In general, the condensation reaction between the hydroxymethyl phosphorus compound and the aminoalkylphosphonate is performed by thoroughly mixing an aqueous solution of the aminoalkylphosphonate with an aqueous solution of the hydroxymethyl phosphorus compound and, optionally, heating the resulting solution. The condensation reaction between the hydroxymethyl phosphorus compound and the aminoalkylphosphonate will proceed more rapidly if the solution is heated. Suitable heating conditions are about 50° to 80° C for about 15 to 90 minutes. Hydrolysis of phosphonate ester group is apparently minimal at this stage based upon IR and TLC analysis. It is also possible to apply a mixture of aminoalkylphosphonate and methylol phosphorus compound to fabric, optionally with a nitrogeneous resin adjuvant, and have the condensation reaction occur in situ. It has, however, been noted that is such circumstances, bath stability is not as good.

The preferred phosphorus reactants are tris(hydroxymethyl) phosphine and formaldehyde or tetrakis(hydroxymethyl) phosphonium salts. Tris(hydroxymethyl)phosphine may be used as such in forming an oligomeric condensation product or it may be formed in situ by the addition of a base as sodium hydroxide to a tetrakis(hydroxymethyl)phosphonium salt. When starting with the phosphine derivative, it is often desirable to include formaldehyde in approximately equimolar amounts.

It has been found in preparing the oligomeric condensate that it is not necessary to start with a fully reacted aminoalkylophoshphonate. A mixture or a partially reacted mixture of a phosphite ester, a carbonyl compound and an amino-compound can be mixed with a solution of a methylol phosphorus compound and the components of the solution will then react together to form an oligomeric condensation product of the type described. Alternatively, an oligomeric condensation product of the type described may be made by the reaction of a hydroxymethylphosphonate of the formula

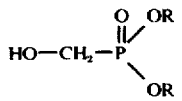

with a suitable amino compound and a hydroxymethyl phosphorus compound, or by the reaction of such a hydroxyalkyl phosphonate with the reaction product of an amino compound of the kind described earlier and a hydroxymethyl phosphorus compound. Alternatively, an oligomeric condensation product of the type described may be made by the reaction of a dialkyl phosphite with a hydroxymethyl phosphorus compound and the condensation product of a carbonyl compound and an amino-compound such as hexamethylene tetramine.

The oligomeric condensation products of this invention are water soluble materials which remain stable for six months or longer without any insoluble polymers being formed. They are different from the starting materials as can be easily demonstrated, for example, by IR and TLC.

The reactions which form the oligomeric condensation products of this invention are preferably, though not necessarily, effected in aqueous media, to form aqueous solutions which can be applied to textiles, optionally after addition of further agents and/or further dilution with water. Alcohols and/or inert solvents such as dioxane, dimethyl formamide, dimethyl sulfoxide, and the like, can also be used.

The water soluble oligomeric condensation products of this invention are believed to include the structures:

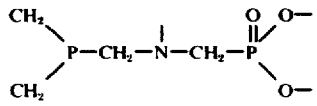

-continued

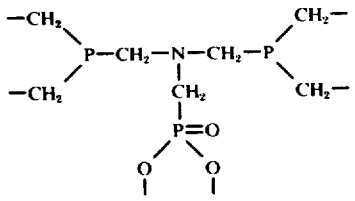

and

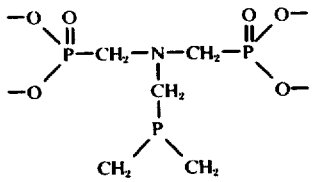

Because the novel products are water soluble and of higher molecular weight than THP salts, they have much less tendency to migrate to the surface of textiles when treated textiles are dried. Their aqueous solutions result in more uniform application of the active material than do applications of aqueous dispersions of water insoluble materials.

The water soluble condensation products of this invention contain methylol groups attached to phosphorus which are capable of reacting further with aminoplast resins, cellulose, etc., to graft them onto cellulose and to form insoluble polymers in and on the textile fabric. This is probably what occurs during the curing of the textile fabric. The fixation of both phosphorus and nitrogen in sufficient amounts is what imparts to the textile flame retardance which withstands multiple launderings.

The water-soluble condensation products of the present invention may be applied by any convenient means to textile materials, alone or in conjunction with about 2 to 50%, preferably about 15 to 40%, their weight of one or more of (1) aminoplast resins, (2) urea, and (3) thiourea. Normally the application would be made by padding the textile material with aqueous solutions of these products. The textile material is then dried or partially dried and then may be cured by: (1) a chemical cure in which the dried or partially dried fabric is exposed to ammonia - either gaseous or aqueous or a combination of the two; (2) a thermal cure in which the dried or partially dried fabric is subjected to elevated temperature for a time sufficient to fix the condensation products on and in the textile material, usually to a temperature of about 125° to 190° C for about 15 seconds to 10 minutes; or (3) a combination cure in which the dried or partially dried textile materials are exposed first to a thermal cure and then to a chemical with ammonia.

The preferred cure is the thermal cure since this requires no special finishing equipment and, suprisingly, in many cases gives a better handle to the fabric. An ammonia cure after a thermal cure, however, increases the durability of flame retardance to repeated launderings.

The preferred method is to dissolve the condensation product and a methylolmelamine resin in water with a wetting agent and a softener. The textile fabric is padded with this aqueous solution, dried and then thermally cured in an oven. The textile material is thereafter washed in water containing a surfactant and an oxidizing agent such as sodium perborate or a combination of $H_2O_2$ and a base such as sodium silicate to remove unreacted material and improve the flame-retardance of the fabric.

Other fire retardants may also be applied to the fabric, either before, simultaneously with or after the treatment with the condensation product. For example, phosphates such as tris(2,3-di-bromopropyl)phosphate may even be in the fiber as produced, as by dissolution in the solution which is spun into cellulose acetate fiber. The conjoint use of another fire retardent permits each to be used in less amount than if used alone. Since tris(di-bromopropyl)phosphate is a plasticizer for many fibers, it minimizes and perhaps positively enhances any effect on the hand of the fabric which might result from the condensation products.

The materials or substrates to which this invention is applicable, include textiles or webs formed of cotton, linen, bast fibers, regenerated cellulose, rayon, partially etherified and esterified cellulose materials; synthetic fibers such as polyester, nylon and other polyamides, acrylics, modacrylics, polyvinyl chloride, polyphposphonate fibers (such as sold under the trademark Heim), vinyon, wool, silk and blends of these synthetic fibers with the aforementioned cellulosic fibers, for example cotton or rayon present in about 35 to 50% by weight of a blend with polyester. The textile materials may be in the form of fibers, yarns, fabrics (woven, non-woven, and knitted), webbings, and the like.

Other than the water soluble condensation products of this invention, no product is available to meet the children's sleepwear standard with polyester-cotton blend fabrics which comprise one-third of the total textile fabrics produced in the United States. Textile materials treated in accordance with the invention retain their flame retardance after more than 50 launderings and tumble-dryings when tested according to FF 3-71, the Children's Sleepwear Standard. The novel products are also useful for treating all types of cellulosic materials, wool and blends of cellulosic fibers with wool, mohair, nylon, acrylics, vinyon, modacrylics, and other fiber types.

The amounts of condensation product applied to the textile material may be widely depending upon the level of flame retardance desired as well as the level of wash fastness desired. Advantageously it will be at least about 5% by weight of the untreated textile material and preferably at least about 10%. It can be as high as about 50% or even higher but little additional benefit is gained by going above about 35%. The pick-up can be adjusted by the concentration of condensation product in the solution employed, which is generally about 20 to about 60% by weight. The composition and construction of the textile as well as the extent of squeezing out of the impregnated textile material can also be used to adjust the pick-up.

The following examples, wherein all parts are by weight unless otherwise expressed, illustrate the practice of the invention.

EXAMPLE 1

Procedures A B and C illustrate the preparation of dimethyl aminomethylphosphonate (DAMP).

Procedure A

29% Aqueous ammonia (58.6 g of solution, containing 1.0 mole of $NH_3$) was slowly added to 37% aqueous formaldehyde (81.1 g of solution containing 1.0 mole of $CH_2O$) with agitation and external cooling, and at such a rate that the resulting exothermic reaction did not cause the temperature to exceed 35° C. Dimethyl phosphite (110.1 g, 1.0 mole) was then dripped in with agitation and external cooling at such a rate that the temperature of the solution never exceeded 30+ C. The pH of the resulting solution was found to be 7.0.

A thin layer chromatogram of the product showed formation of a new product and also showed the presence of an undetermined quantity of dimethyl phosphite. The infrared spectrum of the product was consistent with the spectrum that would be expected for DAMP with some unreacted starting materials.

Procedure B

37% Aqueous formaldehyde (121.6 g of solution containing 1.5 moles) was added to dimethyl phosphite (165 g, 1.5 moles) with agitation. 29% Aqueous ammonia (87.9 g of solution containing 1.5 moles) was then dripped slowly into the cooled, stirred solution so as to maintain the temperature below 60° C. The product was let cool and after 1 hour the pH was 4.7.

The thin layer chromatogram showed a greater degree of reaction than was achieved using Procedure A, although some unreacted dimethyl phosphite was seen to be present. The infrared spectrum was similar to that of the product from Procedure A.

Procedure C

Hexamethylenetetramine (14 g, 0.1 mole) was slurried in dimethyl phosphite (66 g, 0.6 mole) at 60° C and 29% aqueous ammonia (11.7 g of solution containing 0.2 mole) was dripped into the stirred slurry. The mixture was stirred at 70° C for 2 hours and then let cool. The product was a clear, colorless syrup.

Thin layer chromatography showed that most of the dimethyl phosphite and hexamine had been converted to primarily one new component. The infrared spectrum was consistent with the structure of dimethyl aminomethylphosphonate.

EXAMPLE 2

This illustrates the preparation of a water soluble condensate from THP chloride and DAMP using a 2:1 molar ratio of phosphonium salt to phosphonate.

The pH of an 80% aqueous solution of tetrakis(hydroxymethyl) phosphonium chloride (238.1 g of solution containing 1.0 mole) was adjusted to 5.5 with 50% aqueous sodium hydroxide solution and an aqueous solution of DAMP (124.9 g of solution containing 0.5 mole), prepared as described in Example 1 Procedure A, was added to it with stirring. The pH fell slowly to about 4.0 and was then adjusted to 5.6 with 50% sodium hydroxide solution (22.2 g of solution). The solution was heated at 65° C for 40 minutes and then cooled to room temperature. After standing 20 hours, the pH was 2.7. Thin layer chromatography showed that the THP salt had reacted to form a new substance and that dimethyl phosphite was absent.

EXAMPLE 3

This illustrates the preparation of a water soluble condensate from a mixture of tris(hydroxymethyl)-phosphine, formaldehyde, THP chloride and DAMP using a 1:1 molar ratio of methylol phosphine compounds to phosphonate.

25% Aqueous sodium hydroxide (29.3 g of solution containing 0.37 mole) was slowly mixed with chilled 80% THP chloride (119.1 g of solution containing 0.5 mole). The resulting pH was 7.0. DAMP solution (115.6 g of solution containing 0.47 mole), prepared as described in Example 1 Procedure B, was then added with stirring and the solution was heated for 50 minutes at 60°–65° C. After standing 20 hours, the pH was 5.4. Thin layer chromatography showed that the methyl phosphine derivatives had reacted to form a new substance and that dimethyl phosphite was absent.

EXAMPLE 4

This illustrates the preparation of a water soluble condensate from Pyroset TKP (a commercially available solution of THP acetate and phosphate) and DAMP using a 2:1 molar ratio of phosphonium salt to phosphonate.

DAMP solution (124.9 g of solution containing 0.5 mole), made in accordance with Example 1 Procedure A, was added to 310 g (1.0 mole) of stirred tetrakis(hydroxymethyl)phosphonium acetate-phosphate equimolar mixture (sold under the trademark Pyroset TKP). The pH was 5.2. The stirred solution was heated for 1 hour at 60° C and allowed to cool. After 20 hours, the pH was 3.4. Thin layer chromatography showed that the THP salt had reacted to form a new substance and that dimethyl phosphite was absent.

EXAMPLE 5

This illustrates the preparation of a water soluble condensate from Pyroset TKS (a commercially available solution of THP oxalate) and DAMP using a 2:1 molar ratio of phosphonium salt to phosphonate.

DAMP solution (124.9 g of solution containing 0.5 mole), made in accordance with Example 1 Procedure A, was added to 310 g (1.0 mole) of stirred tetrakis(hydroxymethyl)phosphonium oxalate sold under the trademark Pyroset TKS). The stirred solution was heated for 1 hour at 60° C and allowed to cool. After 20 hours, the pH was 3.0. Thin layer chromatography showed that the THP salt had reacted to form a new substance and that dimethyl phosphite was absent.

EXAMPLE 6

This illustrates the preparation of aqueous diethyl aminomethylphosphonate and its subsequent reaction with THP chloride in a 1.5:1 molar ratio of phosphonium salt to phosphonate to give a water soluble condensate.

29% Aqueous ammonia (58.6 g of solution containing 1 mole) was added slowly to 37% aqueous formaldehyde (81.1 g of solution containing 1 mole) and the resulting solution was cooled to 50° C. Diethyl phosphite (138.1 g, 1 mole) was then added with stirring. The reaction mixture did not exotherm noticeably and thin layer chromatography showed the presence of a considerable amount of unreacted diethyl phosphite. The pH was 6.3. This solution was then added to 8:0% aqueous THP chloride (357.2 g of solution containing 1.5 moles). The pH dropped to 2.2 and was immediately adjusted to 5.7 with 50% aqueous sodium hydroxide (38 g of solution). The solution was then heated for forty-five minutes at 60°–65° C and allowed to cool. The pH, after standing for 20 hours, was 4.0. Thin layer chromatography showed that the THP salt had reacted to form a new substance and that very little diethyl phosphite remained unreacted.

EXAMPLE 7

This illustrates the preparation of tetramethyl ethylenbis(aminomethylphosphonate) and its subsequent reaction with THP chloride in a 1.5:1 molar ratio of phosphonium phosphorus to phosphonate, to give a water soluble condensate.

Ethylene diamine (30.1 g, 0.5 mole) was added slowly to stirred, cooled 37% aqueous formaldehyde (81.1 g of solution containing 1.0 mole); the resulting reaction was highly exothermic. Diemethyl phosphite (110 g, 1.0 mole) was then slowly added to the solution after cooling; again, an exothermic reaction occurred. Thin layer chromatography of the product showed some unreacted dimethyl phosphite. The pH was 4.8. The product solution was then added to 80% aqueous THP chloride (357.2 of solution containing 1.5 moles). The pH, which fell to 1.8, was immediately adjusted to 5.7 with 50% aqueous sodium hydroxide (32 g of solution). The solution was then heated for forty-five minutes at 60°–65° C and allowed to cool. The pH, after standing for twenty hours, was 2.8. Thin layer chromatography showed the absence of THP slat and dimethyl phosphite.

Example 8

This example illustrates the preparation of tetrametyl diaminoethanediphosphonate and its subsequent reaction with THP chloride in a 3:1 molar ratio of phosphonium salt to diphosphonate, to give a water soluble condensate.

29% Aqueous ammonia (58.6 g of solution containing 1.0 mole) was slowly added to a stirred, cooled solution containing 40% aqueous glyoxal (72.5 g of solution containing 0.5 mole) and dimethyl phosphite (100.1 g 1.0 mole). The temperature rose to 50° C and the product solution, which was dark brown, was seen by thin layer chromatography to contain considerable unreacted dimethyl phosphite. The product solution (120.6 g of solution containing 0.25 mole) was then added to 80% aqueous THP chloride (178.5 g of solution containing 0.75 mole), the pH of which had been adjusted to 5.5. The pH fell slowly and was readjusted to 5.5 with 50% aqueous sodium hydroxide (25 g of solution). The solution was hated for one hour at 60° C and let cool. After standing 24 hours, the pH was 3.2. Thin layer chromatography showed the product to contain some unreacted THP salt and phosphonate ester.

EXAMPLE 9

This example illustrates the preparation of a water soluble condensate having a 1.5:1 molar ratio of phosphine derivative to phosphite, from tris(hydroymethyl)phosphine, dimethyl phosphite, ammonium chloride and aqueous formaldehyde.

37% Aqueous formaldehyde (40 6 g of solution containing 0.5 mole) was slowly added to a stirred slurry of tris)hydroxymethyl)phosphine (93 g, 0.75 mole) and ammonium chloride (26.8 g, 0.5 mole) in dimethyl phosphite (55.0 g, 0.5 mole). An exothermic reaction occurred and a thick white past was produced upon completion of the formaldehyde addition. The mixture was heated and the precipitate redissolved at about 60°–70° C. The temperature was kept at 60° C for 50 minutes and then the solution was allowed to cool. The pH, which was 0.4, was adjusted to 6.3 with 50% aqueous sodium hydroxide (36.8 g of solution) and the solution was heated for forty minutes at 50°–70° C. Thin layer chromatography showed the absence of THP and THP chloride but did show the presence of some unreacted dimethyl phosphite.

EXAMPLE 10

This example illustrates the preparation of a product of a THP salt and urea condensation in a 2:1 molar ratio and the subsequent reaction of this condensation product with DAMP in a 2:1 molar ratio of phosphonium salt to phosphonate ester.

Urea (90.0 g, 1.5 moles) was dissolved in 80% aqueous tetrakis(hydroxymethyl)phosphonium chloride (714.6 g of solution containing 3.0 moles) and the solution was heated with stirring for 90 minutes at 95° C. The resulting condensate solution was cooled to 15° C and adjusted to a pH of 6.8 with 50% NaOH (180 g of solution). DAMP solution (374.7 g of solution containing 1.5 moles), made in accordance with Example I Procedure A, was then added and the resulting solution was stirred for 1 hour at 60° C. After cooling, the pH of the product was 5.0. Thin layer chromatography showed that all of the dimethyl phosphite had reacted.

EXAMPLE 11

This example illstrates the preparation of an aminomethyl phosphonate from monomethylamine and its subsequent reaction with THP chloride.

Monomethylamine (31.1 g, 1.0 mole) was bubbled into a stirred solution containing 37% aqueous formaldehyde (81.2 g of solution containing 1.0 mole) and dimethyl phosphite (110.1 g, 1.0 mole). There was an exothermic reaction and the temperature was maintained at no more than 45° C by cooling. The solution was then stirred at 45° C for thirty minutes. TLC showed that most of the dimethyl phosphite has reacted. The pH of the product was 7.0. TLC showed some unreacted THP and THPC and that at least one new substance was present.

EXAMPLE 12

This example illustrates the preparation of an aminomethyl phosphonate from dimethylamine and describes an unsuccessful attempt to react to subsequently with THP chloride.

Dimethylamine (45.1 g, 1.0 mole) was bubbled into a stirred solution containing 37% aqueous formaldehyde (81.2 g of solution containing 1.0 mole) and dimethyl phosphite (110.1 g, 1.0 mole). There was an exothermic reaction and the temperature was maintained at 45° C by external cooling. The solution was then stirred at 45° C for 30 minutes. TLC showed dimethyl phosphite to be absent. The product was added to a chilled solution of 80% THP chloride (476.2 g of solution containing 2.0 moles), the pH of which has been adjusted to 7.0–7.5 with 50% NaOH (120 g of solution containing 1.5 moles). The solution was then heated at 70° C with stirring for 1 hour and cooled. The pH of the product was 7.6 after standing 20 hours. TLC showed considerable unreacted THP and THPC with very little new product evident at the origin spot.

EXAMPLE 13

This illustrates the use of ethylene urea instead of urea when preparing a product according to Example 10.

A mixture of ethylene urea (21.5 g, 0.25 mole) and aqueous 80% THP chloride (119.1 g of solution containing 0.5 mole) was heated with stirring at 70°–80° C for 90 minutes and cooled. 50% Aqueous NaOH (30 g of solution containing 0.375 mole) was added with stirring and then DAMP (0.25 mole, made according to Example 1C) was added. The resulting solution exothermed to 60° C and was subsequently heated for 1 hour at 60° C with stirring.

EXAMPLE 14

This example illustrates the preparation of a product from dimethyl ureidomethylphosphonate and THP chloride.

An agitated slurry containing 91% para-formaldehyde (62.2 g of solution containing 2.1 moles), urea (120 g, 2 moles), triethylamine (2.5ml) and trimethyl phosphite (523 g, 4.22 moles) was maintained at a temperature of 80°–85° C until the resulting exothermic reaction had ceased and the suspended solids had largely disappeared. The product was fractionally distilled at atmospheric pressure to yield methanol (64 g, 2 moles) and trimethyl phosphite (43 g). Most of the remaining excess trimethyl phosphite was removed by striping to a temperature of 140° C at an absolute pressure of 1.5 mm Hg. The syrupy product was thinned by admixture with water. The addition of water also resulted in the conversion of the small remaining amount of trimethyl phosphite to dimethyl phosphite.

The dimethyl ureidomethylphosphonate product (192.5 g, 1.0 mole) was mixed with 80% THP chloride (238.1 g of solution containing 1.0 mole) to which there had previously been added 60 g of 50% aqueous NaOH (0.75 mole). The mixture was heated at 80°–85° C for 1 hour and cooled. The pH of the product was 4.9 TLC analysis showed the absence of THP and di- and trimethyl phosphites.

EXAMPLE 15

This example illustrates the preparation of a product from crude tetramethyl ureido-bis(methyl phosphonate) and THP chloride.

An agitated slurry containing 91% para-formaldehyde (132 g of solution containing 4.0 moles), urea (120 g, 2 moles), triethlamine (3 ml) and trimethyl phosphite (496 gm, 496 gm, 4.0 moles) was maintained at a temperature of 85°–95° C until the resulting exothermic reaction had ceased and the suspended solids had largely disappeared. The product was fractionally distilled at atmospheric pressure to a temperature of 170° C to yield methanol (97.5 g, 3.05 mole). The cooled product was thinned with water (50 ml) which also served to convert unreacted trimethyl phosphite to dimethyl phosphite.

The product (157.5 g, 0.74 mole active phosphorus) was mixed with 80% THP chloride (119.1 g of solution containing 0.5 mole) to which there had previously been added 30 g of 50% NaOH (0.375 mole). The mixture was heated at 80°–90° C for one hour and cooled. The pH of the product was 2.8. TLC analysis showed the absence of THP and di- and trimethyl phosphites.

EXAMPLE 16

This illustrates the preparation of a melaminealkylphosphonate.

An agitated slurry containing 91% paraformaldehyde (264 g of solution containing 8 moles), melamine (252 g, 2 moles) 50% aqueous NaOH (5 drops) and methanol (200 ml) was heated at 70° C for 1 hour, by which time considerable thickening had occurred. Methanol (150 ml) was added to thin the product and trimethyl phosphite (496 g, 4.0 moles) was dripped into the agitated paste over a period of 2 hours and at a temperature of about 50° C. The product was kept slightly basic by the periodic addition of triethanolamine (about 5 ml total) and the mix was refluxed for ninety minutes by which time the odor of trimethyl phosphite was no longer evident and the odor of formaldehyde had largely disappeared. The resulting thin milky syrup was filtered to yield a slightly opalescent product.

EXAMPLE 17

This illustrates the preparation of a product from the methylol melamine alkylphosphonate made according to EXAMPLE 16 and THP chloride.

The product of Example 16 (103 g, 0.2 mole) was mixed with 80% THP chloride (95.3 g of solution containing 0.4 mole) to which there had previously been added 16 g of 50% NaOH (0.2 mole). The mixture was stirred at 60° C for one hour and cooled.

The pH was 4.7. TLC analysis showed THP to be absent and a new product to have formed.

EXAMPLE 18

DAMP (0.5 mole) was prepared in accordance with Example 1A. 37% Formaldehyde solution (81.1 g of solution containing 1.0 mole) and urea (30 g, 0.5 mole) were dissolved with stirring in the aqueous DAMP solution which was then heated at 70° C for 2 hours. The product, which gelled on cooling, easily redissolved on heating to 70°–80° C on a water-bath. TLC showed the absence of dimethyl phosphite and indicated, although not conclusively, that the DAMP also has reacted. Less than 1% $CH_2O$ was found to be present, showing that at least 85% of the $CH_2O$ had reacted. IR spectrum showed a small hydroxyl peak indicting greater consumption of the methylol groups which would expectedly form by reaction of urea and $CH_2O$.

This product was added to 80% THPC (238.1 g of solution containing 1 mole), which had been partially converted to THP and $CH_2O$ by prior reaction with 50% NaOH (60 g of solution containing 0.75 mole). There was a mildly exothermic reaction which carried the temperature to about 50° C. The solution was heated at 60° C for 1 hour and cooled.

EXAMPLE 19

The pH of a product prepared according to Example 2 was adjusted to 5.0. A 3.5 oz./sq. yd. 50/50 polyester/cotton muslin was padded through a solution containing 60% by weight of this product, 9% of Resloom HP (dimethylol melamine from the Monsanto Company), 4% urea, and 0.1% of Triton X-100 (an ethoxylated nonylphenol wetting agent from Rohm and Hass Company), the balance of the solution being water. Wet pick-up was 78%. The fabric was dried for five minutes at 110° C, cured for 4 minutes at 160° C and given an oxidizing scour in a solution containing 0.1% hydrogen peroxide, 0.01% sodium silicate and 0.01% sodium hydroxide, at a temperature of 60° C. The fabric was then rinsed and dried.

The handle of the treated fabric was considered to be commercially satisfactory.

The flammability test results, obtained in accordance with the DOC FF 33-71 Children's Sleepwear Standard, after multiple launderings, are recorded in Table I.

EXAMPLE 20

A 5.0 oz./sq. yd. 50/50 polyester/cotton woven fabric was padded through a solution containing 59% of a product prepared according to Example 3, 12% Resloom HP and 0.1% Triton X-100, the balance to 100% being water. Wet pick-up was 80%. The fabric was dried for five minutes at 110° C, cured for 5 minutes at 150° C and given an oxidizing wash in a solution containing 0.1% hydrogen peroxide, 0.01% sodium silicate and 0.01% sodium hydroxide. The fabric was judged to be commercially acceptable. The flammability test results, obtained in accordance with FF 3-71, the Children's Sleepwear Standard, are recorded in Table I.

EXAMPLE 21

The pH of the product prepared according to Example 4 was adjusted to 5.0. A 3.5 oz/sq. yd. 50/50 polyester/cotton muslin was padded through a solution containing 67% of this product, 9% Resloom HP, 4% urea and 0.1% Triton X-100, the balance of 100% being water. Wet pick-up was 80%. The fabric was dried for 5 minutes at 110° C, cured for 4 minutes at 160° C and given an oxidizing wash in a solution containing 0.1% hydrogen peroxide, 0.01% sodium silicate and 0.01% sodium hydroxide, at a temperature of 60° C. The fabric was then rinsed and dried.

The handle of the treated fabric was adjusted esthetically satisfactory. The flammability test results, obtained in accordance with FF 3-71, the Children's Sleepwear Standard, are recorded in Table I.

EXAMPLE 22

A 3.5 oz./sq. yd. 50/50 polyester/cotton muslin was padded through a solution containing 64% of a product prepared according to Example 5, 9% Resloom HP, 4% urea and 0.1% Triton X-100, being water. Wet pick-up was 81%. The fabric was dried for 5 minutes at 110° C, cured for 5 minutes at 150° C and given an oxidizing scour as previously described.

The handle of the fabric was judged commercially acceptable. The flammability test results, obtained in accordance with FF 3-71, the Children's Sleepwear Standard, are recorded in Table I.

EXAMPLE 23

A 5.0 oz./sq. yd. 50/50 polyester/cotton woven fabric was padded through a solution containing 51% of the product prepared according to Example 7, 11.5% Resloom HP and 0.1% Triton X-100, the balance to 100% being water. Wet pick-up was 75%. The fabric was dried for five minutes at 110° C, cured for 4 minutes at 160° C and given an oxidizing scour in a solution containing 0.1% hydrogen peroxide, 0.01% sodium silicate and 0.01% sodium hydroxide, at a temperature of 60° C. The fabric was considered to be commercially satisfactory. The flammability test results, obtained in accordance with FF 3-71, the Children's Sleepwear Standard, are recorded in Table I.

EXAMPLE 24

3.5 Oz./sq. yd. 50/50 polyester/cotton muslin was padded through a solution containing 72% of the product prepared according to Example 8, 8.5% Resloom HP, 3.8% urea and 0.1% Triton X-100, the balance to 100% being water. Wet pick-up was 82%. The fabric was dried for 5 minutes at 110° C, cured for 5 minutes at 150° C and given an oxidizing wash in a solution containing 0.1% hydrogen peroxide, 0.01% sodium silicate and 0.01% sodium hydroxide, at a temperature of 60° C. The fabric was then rinsed and dried. The handle of the treated fabric was considered to be commercially satisfactory. The flammability test results, obtained in accordance with FF 3-71, the Children's Sleepwear Standard, are recorded in Table I.

EXAMPLE 25

4.0 Oz./sq. yd. 35/65 polyester/cotton flannelette was padded through a solution containing 42% of the product prepared according to example 9, 9% Resloom HP, 4% urea and 0.1% Triton X-100, the balance to 100% being water. Wet pickup was 79%. The fabric was dried for 5 minutes at 135° C, cured for 4 minutes at 160° C and given an oxidizing scour in a solution containing 0.1% hydrogen peroxide, 0.01% sodium silicate and 0.01% sodium hydroxide, at a temperature of 60° C. The fabric was then rinsed and dried. The handle of the treated fabric was adjusted commercially satisfactory. The flammability test results, obtained in accordance with FF 3-71, the Children's Sleepwear Standard, are recorded in Table I.

EXAMPLE 26

A 3.4 Oz./sq. yd. 50/50 polyester/cotton shirting fabric was padded through a solution containing 57% of the product prepared according to Example 10, 11.5% Resloom HP and 0.1% triton X-100, the balance to 100% being water. Wet pick-up was 80%. The fabric was dried for 5 minutes at 110° C, cured for 5 minutes at 150° C and given an oxidizing scour as previously described.

The handle of the treated fabric was considered to be commerically satisfactory. The flammability test results, obtained in accordance with FF 3-71, the Children-3 s Sleepwear Standard, are recorded in Table I.

Table I

| | FF 3-71 Flammability Test Results | | |
|---|---|---|---|
| | | Average Char Length, in. | |
| | Applied Phosphorus, Wt. % | 25 Washes | 50 Washes |
| Example 19 | 5.7 | 2.3 | 2.5 |
| Example 20 | 5.5 | 2.5 | 2.5 |
| Example 21 | 5.9 | 2.3 | 2.3 |
| Example 22 | 5.8 | 2.8 | 3.2 |
| Example 23 | 5.0 | 1.8 | 5.6 |
| Example 24 | 5.6 | 2.7 | 3.3 |
| Example 25 | 5.5 | 1.9 | 4.9 |
| Example 26 | 5.0 | 3.4 | 3.3 |

Table I-continued

| FF 3-71 Flammability Test Results | | | |
|---|---|---|---|
| | | Average Char Length, in. | |
| | Applied Phosphorus, Wt. % | 25 Washes | 50 Washes |
| Untreated Control | 0 | B.E.L.* | B.E.L.* |

*Burned entire length

EXAMPLE 27

A 5 oz/sq. yd. 50/50 polyester/cotton fabric was padded through an aqueous solution containing 37.7% by weight of a product prepared according to Example 1C, 11.5% of Resloom HP, 4% of Catalyst AC, the balance being water. Wet pick-up was 100%. The fabric was dried for 5 minutes at 100° C and cured for 5 minutes at 150° C. The cured fabric showed a char length of 3.8 inches when tested by the vertical flame test AATCC 34-1969.

EXAMPLE 28

A 5 oz./sq. yd. 50/50 polyester/cotton woven fabric was padded through a solution containing 53.9% of a product prepared according to Example 11, 11.5% Resloom HP and 0.1% Triton X-100, the balance to 100% being water. Wet pick-up was 81%.

The fabric was dried, cured, oxidized, rinsed and again dried, as described in Example 19.

The handle of the treated fabric was commercially acceptable. When tested for flame retardancy in accordance with FF 3-71, the average char length after 25 washes was 4.4 inches and after 50 washes was 3.3 inches with one specimen out of three burning the entire length.

EXAMPLE 29

A 5 oz./sq. yd. 50/50 polyester/cotton woven fabric was padded through a solution containing 55.3% of a product prepared according to Example 12, 11.5% Resloom HP and 0.1% Triton X-100, the balance to 100% being water. Wet pick-up was 80%.

The fabric was dried, cured, oxidized, rinsed and again dried, as described in Example 19.

The handle of the treated fabric was commercially acceptable. When tested for flame retardancy in accordance with FF 3-71, the fabric had char lengths of ten inches (burned the entire length) after five washes.

EXAMPLE 30

A 3.4 oz./sq. yd. 50/50 polyester/cotton blend shirting fabric was padded to 80% wet pick-up through a bath containing 59.8% of product made according to Example 13, 9% Resloom HP and 0.1% Triton X-100, the balance being water. The treated fabric was dried, cured, oxidized, rinsed and again dried as described in Example 19.

The handle of the treated fabric was commercially acceptable. The char length of the fabric was 3.9 inches when tested by FF 3-71 after 25 launderings.

EXAMPLE 31

A 5 oz./sq. yd. 50/50 polyester/cotton blend fabric was padded to 80% wet pick-up through a bath containing 50% of the product made in Example 14, 10% Resloom HP and 0.1% Triton X-100, the balance being water. The treated fabric was dried for 5 minutes at 110° C, cured for 5 minutes at 150° C and oxidized in a solution containing 0.1% hydrogen peroxide, 0.01% sodium hydroxide and 0.01% sodium silicate, at 60° C. The treated fabric was then rinsed and dried.

The handle of the treated fabric was commercially acceptable. The char length of the fabric was 2.4 inches when tested by FF 3-71 after 25 larunderings.

EXAMPLE 32

A 5 oz./sq. yd. 50/50 polyester/cotton blend fabric was padded to 80% wet pick-up through a bath containing 45% of the product made in Example 15, 12% Resloom HP and 0.1% Triton X-100, the balance being water. The treated fabric was dried, cured, oxidized, rinsed and again dried as described in Example 31. The handle of the treated fabric was satisfactory. When tested in accordance with FF 3-71, the fabric gave a char length of 2.6 inches initially and 2.6 inches after five washes.

EXAMPLE 33

A 5 oz./sq. yd. 50/50 polyester/cotton blend fabric was padded to 80% wet pick-up through an aqueous bath containing 53% of product prepared according to Example 17, 4% urea and 0.1% Triton X-100.

The treated fabric was dried, cured, oxidized, rinsed and again dried as previously described.

The handle of the treated fabric was satisfactory. When tested in accordance with FF 3-71, the fabric gave a char lenth of 2.4 inches initially and 2.5 inches after five washes.

EXAMPLE 34

A 5 oz./sq. yd. 50/50 polyester/cotton blend fabric was padded to 80% wet pick-up through a bath containing 70% of the product made according to Example 18, 7% Resloom HP and 0.1% Triton X-100, the balance being water. The fabric was dried for 5 minutes at 110° C, cured for 5 minutes at 150° C and oxidized in a solution containing 0.1% hydrogen peroxide, 0.01% sodium hydroxide and 0.01% sodium silicate at 60° C. The treated fabric was then rinsed and dried. The handle of the treated fabric was commerically acceptable. The fabric had a char length of 2.2 inches when tested by FF 3-71 after 25 launderings.

EXAMPLE 35

A 3.5 oz/sq. yd. 50/50 polyester/cotton was padded through an emulsion containing 4% by weight of tris-2,3-dibromopropyl phosphate. Wet pick-up was 85%. The fabric was dried for 5 minutes at 110° C, cured for 1.5 minutes at 210° C and washed to remove emulsifiers. The dried fabric was padded through a solution containing 51% of the product from Example 2 (adjusted to pH 5), 9% Resloom HP, 4% and 0.1% of Triton X-100, the balance of the solution being water. Wet pick-up was 80%. The fabric was dried at 110° C, cured for 4 minutes at 160° C and given an oxidizing scour in a solution containing 0.1% $H_2O_2$, 0.01% sodium silicate and 0.01% NaOH, at 60° C. The fabric was then rinsed and dried. The handle of the fabric was adjudged satisfactory. The char length of the fabric was 2.4 inches when tested by FF 3-71, after 35 launderings.

It will be appreciated that the instant specification and examples are set forth by way of illustration and not limitation, and that various modifications and changes may be made without departing from the spirit and scope of the present invention.

What is claimed is:

1. The process for rendering fire retardant to textile material comprising a cellulosic fiber blended with polyester, comprising impregnating and material with a water-soluble condensation product and dimethyl aminomethylphophonate and up to about 6 times its molar amount of at least one member selected from the group consisting of $P(CH_2OH)_3$ and $P(CH_2OH)_4$ Y wherein Y is an equivalent amount of the anion of a least one acid, drying said material, and curing said material by at least one of heating and contact with ammonia.

2. The process of claim 1 wherein said cellulosic fiber is cotton or rayon and is present in about 35 to 50% by weight of the blend, and said impregnating composition additionally contains at least one member selected from the group consisting of a melamine formaldehyde resin, urea and thiourea in about 2 to 50% by weight of the condensation product.

3. The textile material produced by the process of claim 1.

4. The textile material produced by the process of claim 2.

* * * * *